US010392563B2

(12) United States Patent
Kim et al.

(10) Patent No.: US 10,392,563 B2
(45) Date of Patent: Aug. 27, 2019

(54) COKE OVEN WITH IMPROVED EXHAUST GAS CONDUCTION INTO THE SECONDARY HEATING CHAMBERS

(71) Applicants: ThyssenKrupp Industrial Solutions AG, Essen (DE); ThyssenKrupp AG, Essen (DE)

(72) Inventors: Ronald Kim, Essen (DE); Patrick Schwöppe, Dortmund (DE); Rafal Grzegorz Buczynski, Clausthal-Zellerfeld (DE)

(73) Assignees: THYSSENKRUPP INDUSTRIAL SOLUTIONS AG, Essen (DE); THYSSENKRUPP AG, Essen (DE)

( * ) Notice: Subject to any disclaimer, the term of this patent is extended or adjusted under 35 U.S.C. 154(b) by 62 days.

(21) Appl. No.: 15/519,107

(22) PCT Filed: Oct. 16, 2015

(86) PCT No.: PCT/EP2015/073999
§ 371 (c)(1),
(2) Date: Apr. 13, 2017

(87) PCT Pub. No.: WO2016/059208
PCT Pub. Date: Apr. 21, 2016

(65) Prior Publication Data

US 2017/0226425 A1 Aug. 10, 2017

(30) Foreign Application Priority Data

Oct. 17, 2014 (DE) ..... 10 2014 221 150

(51) Int. Cl.
*C10B 15/00* (2006.01)
*C10B 15/02* (2006.01)
*C10B 29/00* (2006.01)

(52) U.S. Cl.
CPC ..... *C10B 15/02* (2013.01); *C10B 15/00* (2013.01); *C10B 29/00* (2013.01)

(58) Field of Classification Search
CPC ..... C10B 15/00; C10B 15/02; C10B 21/18
See application file for complete search history.

(56) References Cited

U.S. PATENT DOCUMENTS 5,114,542 A * 5/1992 Childress ..... C10B 27/06 201/15
6,596,128 B2 7/2003 Westbrook
(Continued)

FOREIGN PATENT DOCUMENTS

CN 1 358 822 A 7/2002
CN 2 500 682 Y 7/2002
(Continued)

OTHER PUBLICATIONS

Int'l Search Report for PCT/EP2015/073999 dated Jan. 5, 2016 (dated Jan. 22, 2016).
English language Abstract for CN 1 358 822 A listed above.

*Primary Examiner* — Jonathan Miller
*Assistant Examiner* — Jonathan Luke Pilcher
(74) *Attorney, Agent, or Firm* — thyssenkrupp North America, Inc.

(57) ABSTRACT

A coke oven may comprise an upper oven and a lower oven beneath the upper oven. Crude gas produced in a coking chamber of the upper oven during a coking process is incompletely combusted in the upper oven and may subsequently be conducted into the lower oven via downwardly directed downcomer channels. The crude gas may flow through an outer sole flue, may be deflected in a transition region, may flow through an inner sole flue, and may exit the lower oven via an exhaust gas collecting channel. The outer and inner sole flues may be supplied with secondary air such that the gas initially partially combusted in the upper oven
(Continued)

by means of primary combustion is completely combusted in the lower oven by means of secondary combustion. The transition region in which the gas is deflected in the lower oven may be divided into a plurality of flow channels.

15 Claims, 6 Drawing Sheets

(56) References Cited

U.S. PATENT DOCUMENTS

| | | | | |
|---|---|---|---|---|
| 8,940,136 | B2 * | 1/2015 | Kim | C10B 15/02 201/15 |
| 9,039,869 | B2 * | 5/2015 | Kim | C10B 15/02 201/15 |
| 2011/0048917 | A1 * | 3/2011 | Kim | C10B 15/02 201/27 |
| 2012/0006668 | A1 * | 1/2012 | Kim | C10B 15/02 201/37 |
| 2014/0262726 | A1 | 9/2014 | West et al. | |

FOREIGN PATENT DOCUMENTS

| | | | |
|---|---|---|---|
| CN | 2 505 478 | Y | 8/2002 |
| DE | 10 2007 061 502 | A1 | 6/2009 |
| DE | 10 2009 015 270 | A1 | 10/2010 |

* cited by examiner

11150

COKE OVEN WITH IMPROVED EXHAUST GAS CONDUCTION INTO THE SECONDARY HEATING CHAMBERS

CROSS REFERENCE TO RELATED APPLICATIONS

This application is a U.S. National Stage Entry of International Patent Application Serial Number PCT/EP2015/073999, filed Oct. 16, 2015, which claims priority to German Patent Application No. DE 10 2014 221 150.6 filed Oct. 17, 2014, the entire contents of both of which are incorporated herein by reference.

FIELD

The present disclosure generally relates to coke ovens and improvements to coke ovens by way of exhaust gas conduction into secondary heating chambers.

BACKGROUND

Changed market requirements regarding the power spectrum of batteries of coke ovens have led to the construction again nowadays of chamber ovens in which the crude gas produced during the coking process is not provided for producing sulfur, tar, benzene, etc., but is directly combusted in the coking chamber (upper oven) and the sole flues (lower oven) arranged below the latter in order to provide the required process heat. The completely combusted gas is then either conducted away into the atmosphere (NR—Non Recovery) or heat is extracted from said gas in a downstream process step, for example in order to produce superheated steam (HR—Heat Recovery). In both cases, these NR/HR ovens substantially differ in the manner of their heating from indirectly heated horizontal chamber ovens in which the heating system and the coking chamber are decoupled materially from each other.

Modern NR/HR ovens are constructed from silica material. Older types of oven are based on fireclay material. Insulating materials are additionally installed in the ceiling region, floor region and in the side regions of the ovens for heat insulation purposes.

The NR/HR ovens of newer type are distinguished in that two-stage combustion and therefore two-stage heating take place in them. Some of the crude gas which is produced is incompletely combusted (primary combustion) in the upper oven directly above the coal mass in the coking space (primary heating space) by addition of primary air. Heat is transmitted here directly by gas and solid-state radiating processes.

The partially combusted gas is then conducted out of the upper oven via downwardly directed downcomer channels located in the lateral oven walls below the oven bottom into the lower oven and is completely combusted there in sole flues (heating flues) by repeated addition of secondary air (secondary combustion) before said gas is evacuated into an exhaust gas collecting channel as a result of the negative pressure operating mode. In the case of known oven structures, at least one and up to 10 downcomer channels are accommodated in an oven wall. The sole flues can be arranged here horizontally, in meandering form or in parallel and coupled to one another in the direction of flow in the form of an approximately U-shaped deflection. By means of the secondary combustion in the sole flues, the complete combustion of the gas which was previously only incompletely combusted during the primary combustion in the upper oven takes place in the lower oven. The heat thus produced in the lower oven by secondary combustion is indirectly transmitted to the coal in the coking chamber located above said lower oven, analogously to the heat transmission mechanisms which are also known, for example, from the conventional horizontal chamber technique.

However, as practice has shown, the time and the quantity of the addition of secondary air have a decisive effect on the uniformity of the heating in the lower oven, especially in the sole flues. The undefined addition of secondary air in the lower oven can immediately lead to high process temperatures above 1600° C. and therefore to melting processes of the construction material of the oven and to destruction of the oven structure. This then inevitably results in failure of coke production since the ovens first of all have to be repaired in a complicated manner in a procedure using heat before they can be filled again.

There is therefore a need for improved geometry for the sole flues, which ensures, with high process efficiency, homogeneous surface heating of the coal charge in the sole flue coupled below the silica support layer, with the unsteady production of combustion gas being taken into consideration, wherein local superheating on the brickwork surface and exhaust gas cooling processes are avoided at the same time. The following are of high importance here in the longitudinal direction of the oven: 1. the positions of the downcomer channels in the lateral oven walls, 2. the structural configuration of the reversing point between outer and inner sole flue, 3. the positions of the secondary air supply openings in the floor of the sole flues, and 4. the regulation of the partial quantities of gas in the downcomer channels.

U.S. Pat. No. 6,596,128 B2 relates to a method for reducing the volumetric flows flowing in a sole exhaust gas system for a coke oven at least during the initial coking process after filling of the coke oven with coal. The method comprises providing a channel system between a first coke oven with a first coking chamber and a second coke oven with a second coking chamber in order to conduct at least some of the gas from a gas space in the first coking chamber to the second coke oven, as a result of which the gas flow rate in the first sole exhaust gas system of the first coke oven is reduced. The reduction in the gas flow rates in the sole exhaust gas system has a positive effect on the product throughput, the service life of the coke oven and the environmental control of volatile emissions from coke ovens.

DE 10 2007 061502 B4 discloses a device for supplying and regulating secondary air from the secondary air channels into the flue gas channels of horizontal coke chamber ovens. The flue gas channels are located here under the coke oven chamber floor on which the coking process takes place. The flue gas channels serve for combusting partially combusted coking gases from the coke oven chamber. The partially combusted coking gases are combusted with secondary air, as a result of which the coke cake is also heated from below for uniform coking. The secondary air comes from the secondary air channels which are connected to the outside air and to the flue gas channels. Regulating elements which can control the airflow into the flue gas channels are installed in the connecting channels between the flue gas channels and the secondary air channels. This enables more uniform heating and distribution of heat in coke chamber ovens.

DE 10 2009 015270 A1 discloses a method and a device for evening out the burn-up characteristics and for reducing the thermal $NO_x$ emissions of a coking plant on the basis of the non-recovery process or the heat-recovery process using a multiplicity of ovens. The ovens each have an oven space delimited by doors and side walls for a bed of coal or a compacted coal cake, and an empty space located above said oven chamber, devices for extracting the exhaust gas from the empty space, devices for supplying fresh air into the empty space, a system of sole flues for conducting exhaust gas or secondary feed air, which system is at least partially integrated into the floor under the oven space, wherein some of the exhaust gas produced in the oven is returned into the oven space via openings or channels for the combustion process of the oven.

CN 2505478Y relates to a coke oven, in particular to a heat recovery coke oven, wherein a smoke flue is installed in the lower part of the furnace flue, and wherein a control device is mounted at the inlet of the smoke flue.

CN 2500682Y relates to a coke oven with a lateral infeed, wherein a combustion chamber is located under the floor plate of the coking chamber, said combustion chamber consisting of four arcuate combustion chambers arranged in the longitudinal direction, and wherein an air channel which is connected to the combustion chamber is located on the floor of the combustion chambers in the longitudinal direction. In this case, two combustion chambers each form a unit and are separated by a partition, wherein overflow openings for the coal gas are located at the ends of the partitions of each combustion chamber unit.

CN 1358822A relates to a heat-recovery tamping-type coke oven which has an arched oven ceiling, a control device for the primary airflow, a control device for the secondary supply of air, a rising furnace flue in the oven wall, a furnace flue leading downward, a four-arch oven floor, and a two-plane structure of the oven doors.

FIG. 1 according to DE 10 2009 015270 A1 shows a single deflection at each of the transitions of the two outer sole flues into the two inner sole flues. Furthermore, the outer downcomer channels are at comparatively large distances from the respectively adjacent outside edge of the oven. In the two outer sole channels over the length of the oven, the cross sections of the downcomer outlet openings and of the secondary air inlet openings are not located at a common level. This geometry takes into consideration deflection cross sections of 0.1 to 1.1 $m^2$. This arrangement with a single deflection of the exhaust gas into the inner sole flues, lack of gas regulation in the downcomer channels and very large distances between the outer downcomer channels and the respectively adjacent outside edge of the oven results in a plurality of disadvantages: the coal charge is non-uniformly heated from below and local superheating occurs associated with a possible destruction of the brickwork materials in the region of the transition of the exhaust gas flow from the outer sole flue into the inner sole flue. This is the case in particular whenever the use limit of the customarily used silica material of approx. 1873 K is locally exceeded. Furthermore, as a consequence of the large distances of the outer downcomer channels from the respectively adjacent outside edge of the oven, the end sides of the coal cake are heated only inadequately, and therefore an insufficient quality of the coke is produced.

The combination of the geometry shown in FIG. 1 of DE 10 2009 015270 A1 with the single-flame design according to U.S. Pat. No. 6,596,128 B2 (FIG. 5) does not lead to an advantageous homogeneous heating of the oven from below either. The adaptation of the known single-flame design according to U.S. Pat. No. 6,596,128 B2 to the known geometry of the sole flue according to DE 10 2009 015270 A1 can cause local superheating associated with tertiary combustion in the exhaust gas system if, for example, as a consequence of a manual operating error, the cross section of the air regulating flap is too greatly throttled or too low a negative pressure is present in the exhaust gas system. In this solution, it is also of disadvantage if, as a consequence of too large a free flow cross section of the air regulating flap or as a consequence of too high a negative pressure in the exhaust gas system, an inadequately high quantity of air is sucked into the sole flues such that the resulting exhaust gas temperature at the heat exchanger located downstream undershoots the nominal value, which is associated in turn with a lower production of steam, i.e. lower process efficiency. At the same time, the cooling of the sole flues leads to an undesirable reduction in the process efficiency of the following charge since this process efficiency is determined by the heat which is generated by crude gas combustion during the coking of the precursor charge and is stored in the brickwork. The throughflow length of the outer and inner sole flues between the coke side and machine side of the oven is customarily 9 to 20 m in each case. Furthermore, the two-sided single-flame solution according to U.S. Pat. No. 6,596,128 B2 therefore has the disadvantage that, in the case of typical flame lengths of in each case only approx. 1.5 to 3.5 m, said flame lengths do not reach into the inner regions of the sole flue and do not generate any additional secondary combustion heat portions there, and therefore the center of the coal charge located thereabove in the coking chamber is frequently characterized by zones of reduced coke quality or even with uncoked coal. If the single-flame solution of U.S. Pat. No. 6,596,128 B2 is applied to the geometry of the application DE 10 2009 015270 A1, a nonuniform temperature level with a large temperature difference between the extreme values of approx. 350 K is produced in the flow profile of the sole flue assembled from the outer part and the inner part. As a consequence of an operating error in the heating setting in the outer sole flue, the maximum use limit of the silica material may then be exceeded, which is synonymous with destruction of the brickwork. At the same time, this setting leads to an undesirable reduction of the exhaust gas temperature with reduced production of steam in the heat exchanger.

DETAILED DESCRIPTION

Figure 1:
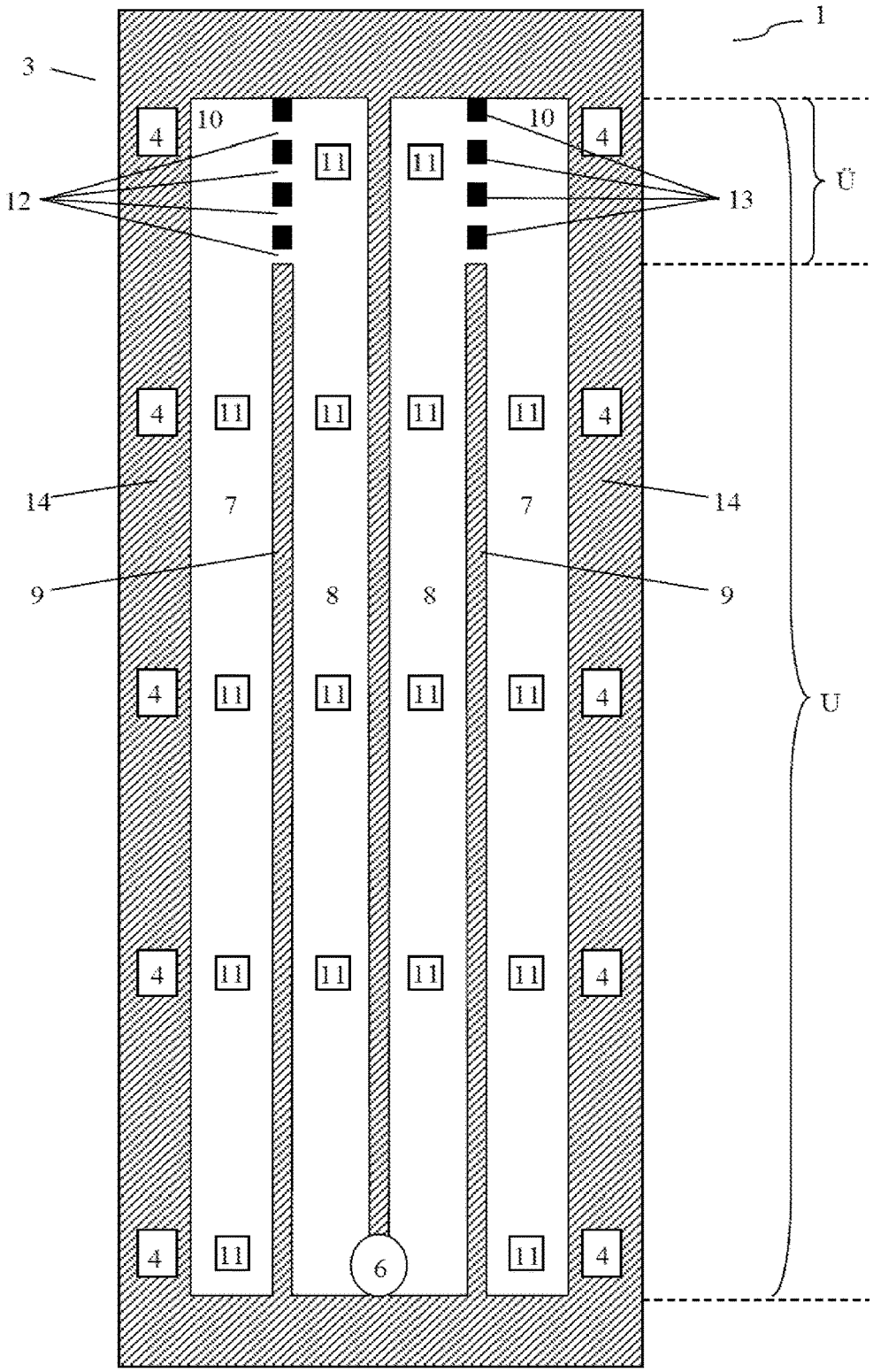
FIG. 1 is a schematic top view of an example coke oven.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The present disclosure generally relates to coke ovens that at least in some examples comprise an upper oven and a lower oven arranged below the latter. The crude gas escaping out of the coal charge under the influence of temperature in a coking chamber of the upper oven during the coking process is incompletely combusted in the upper oven and is subsequently conducted into the lower oven via a plurality of downwardly directed downcomer channels. Said crude gas may flow there through an outer sole flue, is deflected in a transition region, then flows through an inner sole flue and finally leaves the lower oven via an exhaust gas collecting channel. The outer and inner sole flues may be supplied with secondary air such that the gas that is initially only incompletely combusted in the upper oven by means of primary combustion is completely combusted in the lower oven by means of secondary combustion. The transition region in which the gas is deflected in the lower oven is divided into a plurality of flow channels.

The methods and devices of the prior art are therefore not satisfactory in every respect. The present disclosure is based at least in part on the object of overcoming the disadvantages of the prior art and in particular of providing improved geometry for the sole flues, which ensures, with high process efficiency, homogeneous surface heating of the coal charge in the sole flue coupled below the silica support layer, with the unsteady production of combustion gas being taken into consideration, wherein local superheating at the brickwork surface and exhaust gas cooling processes are avoided at the same time.

A first aspect of the invention relates to a coke oven which comprises an upper oven, a lower oven arranged below the upper oven, and a plurality of downwardly directed downcomer channels, with openings, wherein said openings are configured for conducting gas out of the upper oven into the lower oven. The upper oven comprises a coking chamber and a device for supplying primary air.

By means of the supply of primary air, some of the crude gas produced in the upper oven is incompletely combusted (primary combustion) directly above the coal mass in the coking space (primary heating space). Heat is transmitted here directly by gas and solid-state radiating processes.

The partially combusted gas is then conducted out of the upper oven via downwardly directed downcomer channels below the oven bottom into the lower oven. The lower oven comprises an exhaust gas collecting channel, an outer sole flue and an inner sole flue for conducting gas, wherein the outer sole flue and the inner sole flue are separated from each other by a partition, preferably a common partition, and are connected to each other via a transition region. In addition, the lower oven comprises secondary air supply openings for supplying secondary air into the outer sole flue and into the inner sole flue.

The supply of secondary air causes the complete combustion of the gas (secondary combustion) which has previously only been incompletely combusted during the primary combustion in the upper oven in the sole flues in the lower oven. The heat thus produced in the lower oven by secondary combustion is indirectly transmitted to the coal in the coking chamber located above the lower oven. In the lower oven, the openings in the downcomer channels, the outer sole flue, the transition region, the inner sole flue and the exhaust gas collecting channel are configured in such a manner that the gas is conducted out of the upper oven via the openings in the downcomer channels into the outer sole flue of the lower oven, flows through the outer sole flue, is deflected in the transition region, flows through the inner sole flue, and leaves the lower oven via the exhaust gas collecting channel.

A plurality of openings in the downcomer channels are arranged along the main direction of extent of the lower oven, wherein the one outer opening to the one outer outside edge of the lower oven and the other outer opening to the other outer outside edge of the lower oven are at a distance X within the range of $0.1\ m \leq X \leq 2.5\ m$, preferably $0.4\ m \leq X \leq 1.0\ m$, in each case along the main direction of extent of the lower oven and in each case independently of each other. The distance X here preferably describes the distance between the center point of the one outer opening and the one outer outside edge of the lower oven or between the center point of the other outer opening and the other outer outside edge of the lower oven, in each case along the main direction of extent of the lower oven and in each case independently of each other (cf. FIG. 2, distances X). The one outer opening and the other outer opening here flank openings optionally located in between, and therefore the one outer opening is arranged terminally (for example proximally) and the other outer opening is likewise arranged terminally (for example distally), whereas the other openings located in between are not terminal.

The coke oven according to the present disclosure also differs from conventional coke ovens in that the transition region is divided into a plurality of flow channels. The plurality of flow channels are preferably each configured in such a manner that the gas is deflected from the outer sole flue into the inner sole flue.

The coke oven according to the invention is preferably used as an element of a battery of coke ovens. In this case, preferably two halves of a lower oven are arranged mirror-symmetrically next to each other, and therefore the unit formed in this manner comprises a total of four sole flues, two outer and two inner sole flues. These pairs of in each case two lower ovens divided in half are then arranged to form groups and thus form the battery of coke ovens. For reasons of expediency, in particular individual elements are explained in more detail below. Units of two such elements which are arranged mirror-symmetrically next to each other are illustrated throughout the figures.

The coke oven according to the invention is preferably an NR oven (NR—Non Recovery), in which the completely combusted gas is conducted away into the atmosphere, or an HR oven (HR—Heat Recovery) in which heat, for example for producing superheated steam, is extracted in a downstream process stage.

The invention solves the problem by a device and a method, wherein the gas is repeatedly deflected by a plurality of flow channels in the transition region from the outer sole flue to the inner sole flue, and wherein said transition region is preferably of U-shaped design. Furthermore, at least 3 downcomer channels, preferably at least 5 downcomer channels, are arranged in a lateral wall of the lower oven in such a manner that the two flanking outer downcomer channels are at a distance of preferably 0.1 to 2.5 m (cf. FIG. 2, distances X) from the respectively outer outside edge of the lower oven. In addition, the downcomer channels adjacent to one another in each case are arranged in the lateral wall of the lower oven in such a manner that they are at a distance of preferably 1.0 to 4.8 m (cf. FIG. 2, distances Y) in each case independently of one another. Furthermore, the secondary air supply openings are preferably arranged in the outer sole flue and in the inner sole flue in such a manner that they are located level (in alignment) with the openings in the downcomer channels in the longitudinal direction of the oven (cf. FIG. 4, distances Y, Q and Q'). One of the two flanking outer secondary air supply openings in the outer sole flue and one of the two flanking outer secondary air supply openings in the inner sole flue are preferably arranged in such a manner that said openings are at a distance of 0.1 to 2.5 m from the outer oven edge (cf. FIG. 3, (11*a*), (11*e*'), distance P). Furthermore, according to the invention, a horizontal regulation of the partial flow evacuated from the coking chamber via the downcomer channels into the outer sole flue (mixture of crude and smoke gases) can preferably be regulated via individual positions of sliding bricks, preferably silica sliding bricks, in such a manner that a uniform distribution of the partial quantities in the downcomer channels over the length of the oven is achieved in the two walls by flow cross sections free to differing extents (cf. FIG. 5, (17*a*) to (17*e*)).

In a preferred embodiment, the transition region which connects the outer sole flue to the inner sole flue and deflects the gas is of substantially U-shaped design.

The transition region is preferably connected at its one end to the one end of the outer sole flue and at its other end to the start of the inner sole flue.

The extent of the transition region along the main direction of extent of the lower oven is preferably at most 30%, more preferably at most 25%, even more preferably at most 20% and in particular at most 15% of the entire extent of the interior of the lower oven.

The outer sole flue and the inner sole flue are preferably arranged substantially horizontally and parallel to each other and are configured in such a manner that the gas flows through them substantially in an opposed direction.

The transition region is preferably divided into 2 to 10 flow channels, preferably into 3 or 4 flow channels.

Preferably, the flow channels independently of one another each comprise a throughflow cross-sectional area A within the range of $0.02\ m^2 \leq A \leq 0.85\ m^2$.

The transition region is preferably divided by 1 to 10 blocking elements into a plurality of flow channels.

The blocking elements are preferably in each case rounded.

The blocking elements preferably in each case independently of one another comprise a cross-sectional area B within the range of $0.01\ m^2 \leq B \leq 0.15\ m^2$.

The openings in the downcomer channels are preferably arranged in a lateral wall which laterally bounds the lower oven and the outer sole flue thereof. Preferably, at least five openings in the downcomer channels are arranged in a lateral wall which laterally bounds the lower oven and the outer sole flue thereof.

Figure 2:
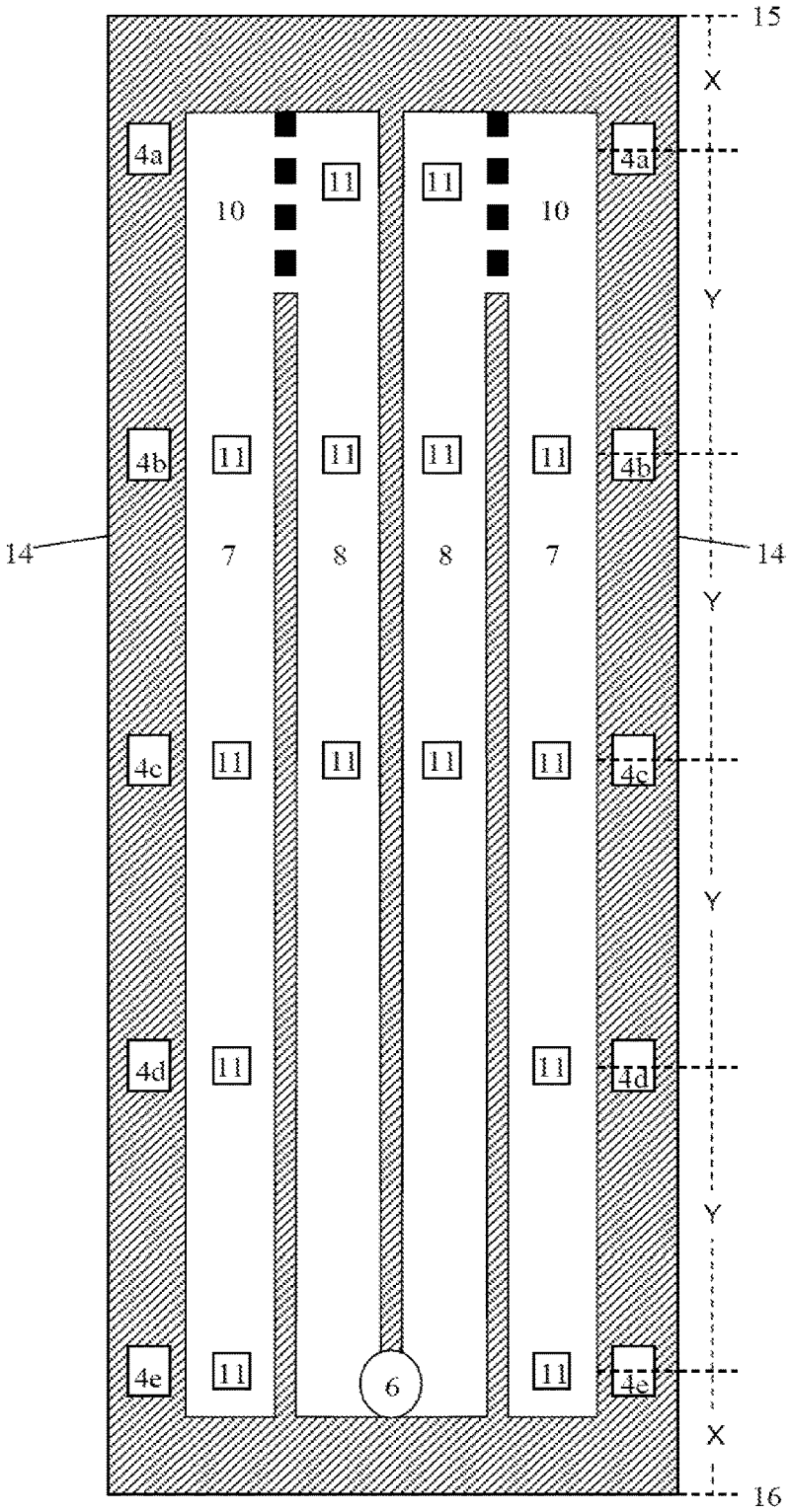
FIG. 2 is another schematic top view of the example coke oven of FIG. 1.

Preferably, two adjacent openings, for example, according to FIG. 2, the openings (4*a*) and (4*b*), and/or (4*b*) and (4*c*), and/or (4*c*) and (4*d*), and/or (4*d*) and (4*e*), are at a distance Y within the range of $1.0\ m \leq Y \leq 4.8\ m$ from each other, more preferably $2.2\ m \leq Y \leq 3.5\ m$, in each case along the main direction of extent of the lower oven (3) and in each case independently of each other.

At least two, preferably at least four secondary air supply openings are arranged in the outer sole flue.

At least two, preferably at least four secondary air supply openings are arranged in the inner sole flue.

Preferably, the secondary air supply openings in the outer sole flue and the secondary air supply openings in the inner sole flue in each case independently of one another comprise a throughflow cross-sectional area C within the range of $0.01\ m^2 \leq C \leq 0.16\ m^2$, more preferably $0.02\ m^2 \leq C \leq 0.04\ m^2$.

Preferably, a plurality of secondary air supply openings are arranged along the main direction of extent of the lower oven in the outer sole flue, and a plurality of secondary air supply openings are arranged along the main direction of extent of the lower oven in the inner sole flue.

Preferably, an outer secondary air supply opening in the outer sole flue to an outer outside edge of the lower oven and another outer secondary air supply opening in the inner sole flue to another outer outside edge of the lower oven are at a distance P within the range of $0.1\ m \leq P \leq 2.5\ m$, more preferably $0.4\ m \leq P \leq 1.0\ m$, in each case along the main direction of extent of the lower oven and in each case independently of each other.

Figure 3:
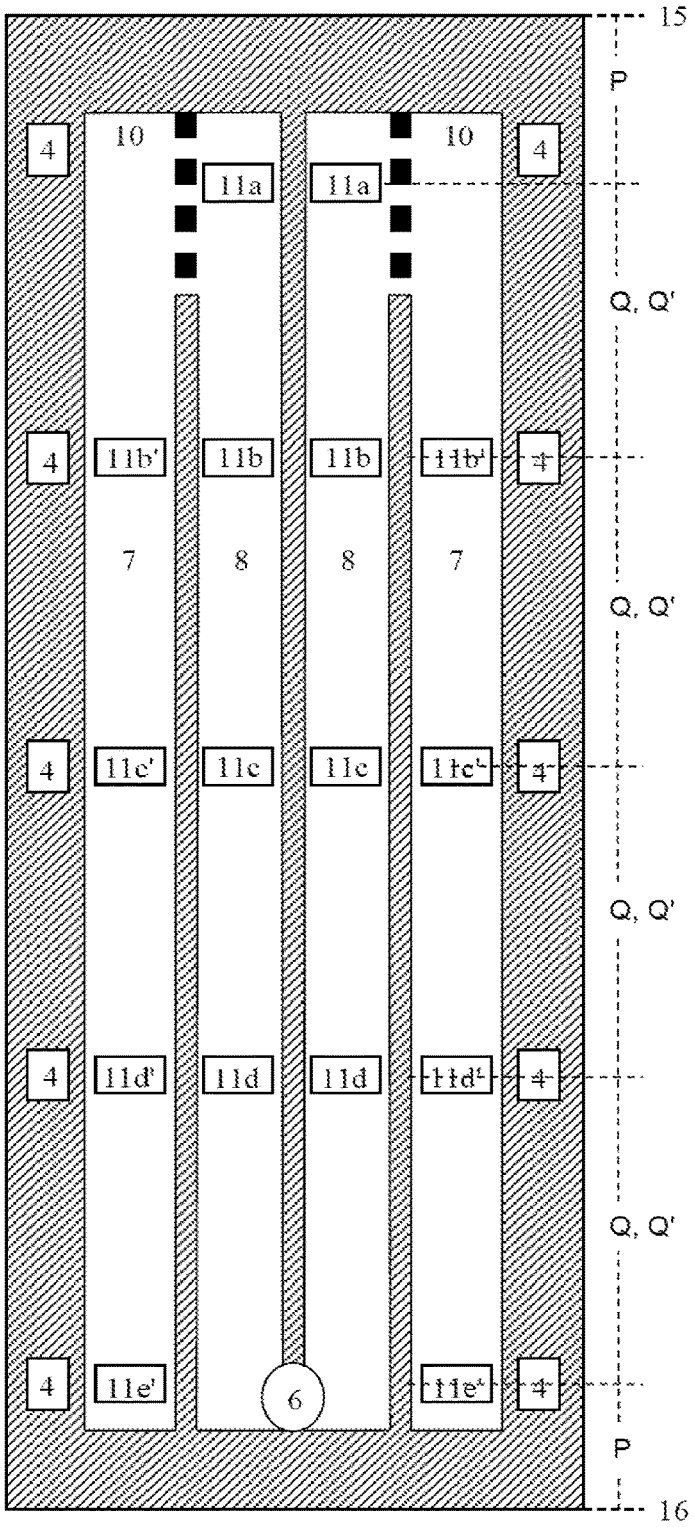
FIG. 3 is still another schematic top view of the example coke oven of FIGS. 1 and 2.

Preferably, in each case two adjacent secondary air supply openings in the outer sole flue, for example, according to FIG. 3, the openings (11*b*') and (11*c*'), and/or (11*c*') and (11*d*'), and/or (11*d*') and (11*e*'), are at a distance Q' within the range of $1.0\ m \leq Q' \leq 4.8\ m$ from each other, more preferably $2.2\ m \leq Q' \leq 3.5\ m$, in each case along the main direction of extent of the lower oven and in each case independently of each other.

Preferably, in each case two adjacent secondary air supply openings in the inner sole flue, for example, according to FIG. 3, the openings (11*a*) and (11*b*), and/or (11*b*) and (11*c*), and/or (11*c*) and (11*d*), are at a distance Q within the range of $1.0\ m \leq Q \leq 4.8\ m$ from each other, more preferably $1.9\ m \leq Q \leq 3.8\ m$, in each case along the main direction of extent of the lower oven and in each case independently of each other.

Preferably, at least one opening in the downcomer channels is arranged orthogonally to the main direction of extent of the lower oven substantially in alignment with a secondary air supply opening in the outer sole flue and/or substantially in alignment with a secondary air supply opening in the inner sole flue. Particularly preferably, at least two, more preferably at least three openings in the downcomer channels are arranged orthogonally to the main direction of extent of the lower oven in each case substantially in alignment with a secondary air supply opening in the outer sole flue and/or in each case substantially in alignment with a secondary air supply opening in the inner sole flue.

Figure 4:
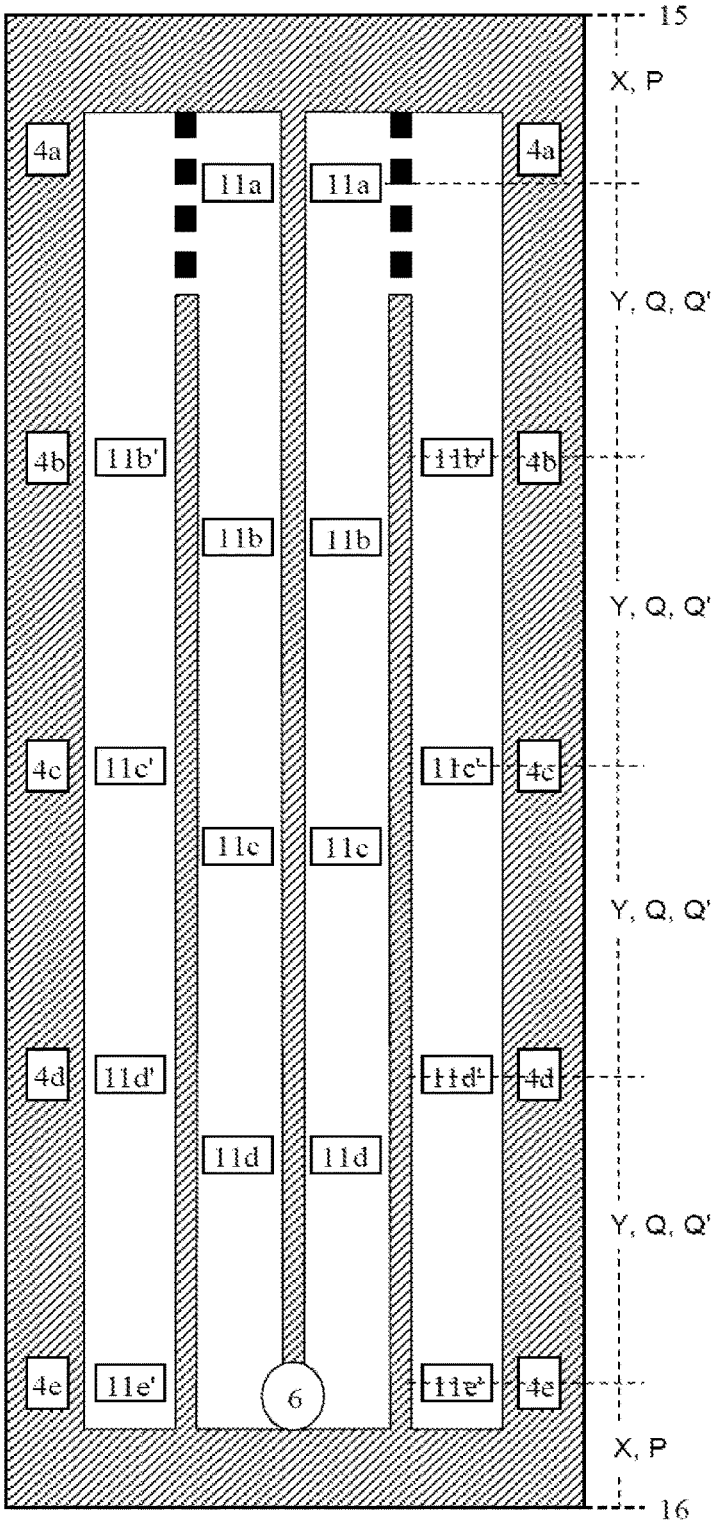
FIG. 4 is yet another schematic top view of the example coke oven of FIGS. 1-3.

Particularly preferably, for example according to FIG. 4,

- opening (4*b*) in the downcomer channel and secondary air supply opening (11*b*') are arranged orthogonally to the main direction of extent of the lower oven in each case substantially in alignment with each other;
- opening (4*c*) in the downcomer channel and secondary air supply opening (11*c*') are arranged orthogonally to the main direction of extent of the lower oven in each case substantially in alignment with each other; and
- opening (4*d*) in the downcomer channel and secondary air supply opening (11*d*') are arranged orthogonally to the main direction of extent of the lower oven in each case substantially in alignment with each other.

However, particularly preferably, for example according to FIG. 4,

- opening (4*b*) in the downcomer channel and secondary air supply opening (11*b*) are arranged orthogonally to the main direction of extent of the lower oven in each case substantially not in alignment with each other;
- opening (4*c*) in the downcomer channel and secondary air supply opening (11*c*) are arranged orthogonally to the main direction of extent of the lower oven in each case substantially not in alignment with each other; and opening (4*d*) in the downcomer channel and secondary air supply opening (11*d*) are arranged orthogonally to the main direction of extent of the lower oven in each case substantially not in alignment with each other.

The throughflow cross section D of the openings in the downcomer channels can preferably be changed individually and independently of one another with sliding bricks.

A further aspect of the invention relates to a method for coking coal comprising the firing of an above-described coke oven according to the invention.

All preferred embodiments of the coke oven according to the invention which have been described above also apply analogously in a corresponding manner to the method according to the invention.

The throughflow cross section D of the openings in the downcomer channels is preferably regulated individually and independently of one another with sliding bricks in such a manner that the gas conducted out of the upper oven via the openings in the downcomer channels into the outer sole flue of the lower oven is distributed uniformly between the openings in the downcomer channels.

Preferably, at least five openings in the downcomer channels are arranged in a lateral wall which laterally bounds the lower oven and the outer sole flue thereof, the throughflow cross section D of which openings can in each case be changed individually and independently of one another with sliding bricks. In this case, preferably when fully open, the throughflow cross section D of each of the at least five openings in the downcomer channels is substantially identical. The actual throughflow cross section D of the openings in the downcomer channels when the method according to the invention is carried out is preferably regulated with the sliding bricks in such a manner that, according to FIG. 5, opening (4*a*) is up to 60 to 95% open, and/or opening (4*b*) is up to 60 to 95% open, and/or opening (4*c*) is up to 70 to 100% open, and/or opening (4*d*) is up to 80 to 100% open, and/or opening (4*e*) is up to 85 to 100% open.

A further aspect of the invention relates to the use of an above-described coke oven according to the invention for coking coal, and to the use of an above-described coke oven according to the invention in an above-described method according to the invention.

All preferred embodiments of the coke oven according to the invention and of the method according to the invention that have been described above also apply analogously in a corresponding manner to the use according to the invention.

By means of the invention, it is possible for the first time to produce a homogenous distribution of the heat sources produced by secondary combustion over the area of the oven below the coal charge to be heated. This surface heating ensures small temperature differences (cf. FIG. 6, curve 2) in the sole flue composed of an outer and inner segment (i.e. in the outer sole flue, in the deflecting region and also in the inner sole flue).

By means of the multiple deflection in the plurality of flow channels in the transition region of preferably U-shaped design, local superheatings at the connection of the outer and inner sole flue, as known from the prior art, are avoided. As a result, melting of the silica brickwork can be avoided. At the same time, an undesirable dropping of the exhaust gas temperatures at the boiler inlet is circumvented.

Figure 5:
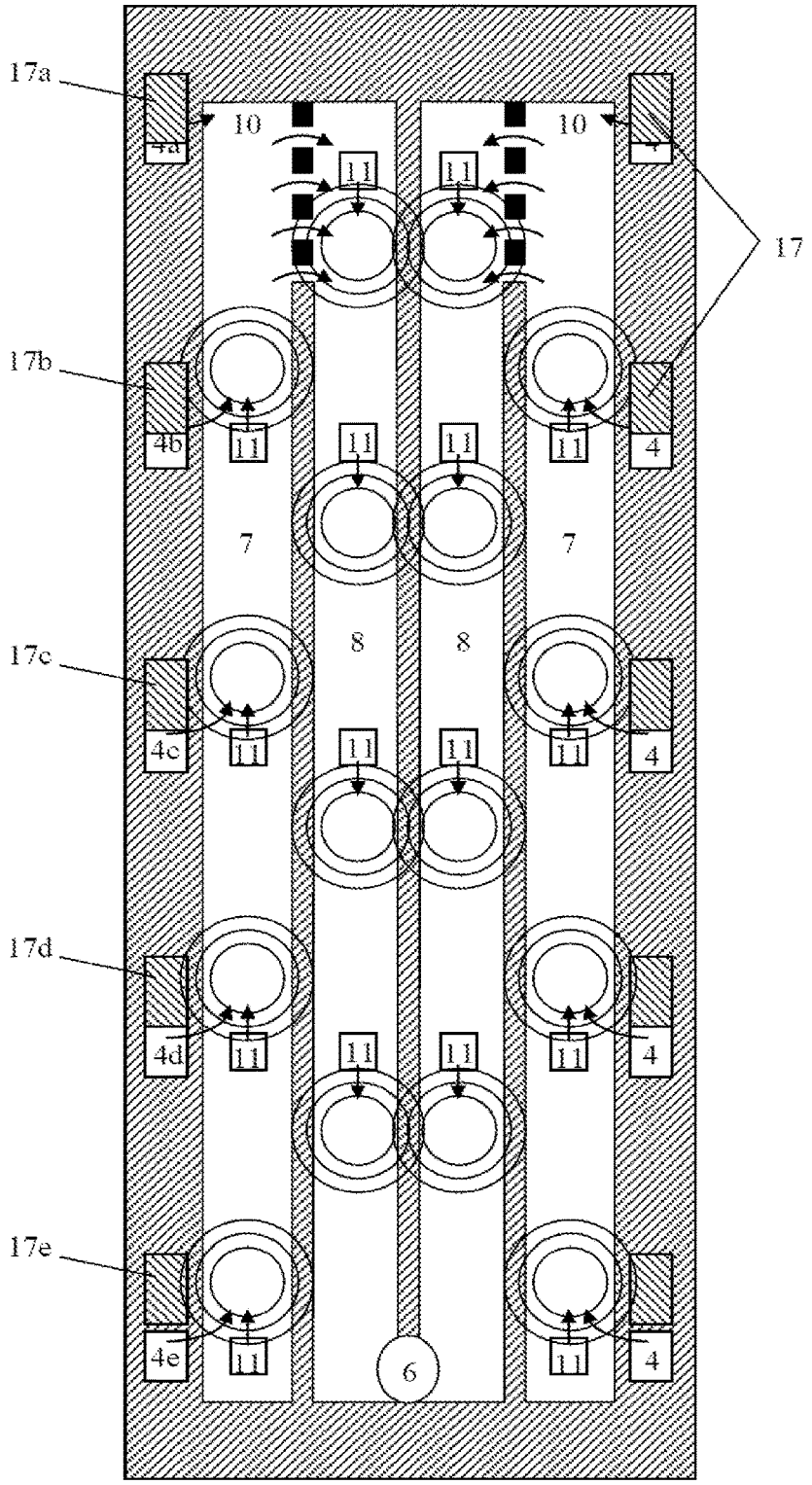
FIG. 5 is a schematic top view of the example coke oven of FIGS. 1-3, wherein the flow of gases are displayed schematically by way of arrows.

A positioning of the secondary air supply openings in the outer sole flues in such a manner that said openings are located in the longitudinal direction of the oven level with the openings in the downcomer channels has the advantage over DE 10 2007 061502 B4 that the secondary combustion is not delayed, but rather arises as desired, directly at the junction points of downcomer gas outlet and secondary air inlet (cf. FIG. 5).

The positioning of the openings, arranged in the lateral wall, in the downcomer channels in such a manner that a distance of 1.0 to 4.8 m arises between adjacent openings (cf. FIG. 2, distances Y) advantageously leads to a uniform distribution of the generated heat, wherein an overlapping of individual flames and therefore of heat sources within the outer sole flue, as known from the prior art of DE 10 2007 061502 B4, is avoided. In the prior art, the arrangement of the openings in the downcomer channels in the lateral walls in the corner regions of the oven charge located above the sole flue often leads to undercoked areas with incompletely coked coal. By means of a positioning according to the invention of the flanking outer openings in the downcomer channels, said openings being arranged in the lateral wall of the lower oven, in such a manner that a distance from the outer oven edge within the range of 0.1 to 2.5 m arises in each case independently of one another, the full coking state in the corners of the charge located thereabove is improved.

Preferred embodiments of the invention are explained in more detail below with reference to the figures. In FIGS. 1 to 5, in each case two halves according to the invention of a coke oven are arranged mirror-symmetrically to form units which each have two outer sole flues, two inner sole flues and a common exhaust gas collecting channel.

FIG. 1 shows schematically a coke oven (1) according to the invention in a top view, comprising an upper oven (not illustrated), a lower oven (3) arranged below the upper oven, and a plurality of downwardly directed downcomer channels with openings (4) which are configured for conducting gas out of the upper oven into the lower oven (3), wherein the upper oven comprises a coking chamber (not illustrated) and a device for supplying primary air. The lower oven (3) comprises an exhaust gas collecting channel (6), an outer sole flue (7) and an inner sole flue (8) for conducting gas, wherein the outer sole flue (7) and the inner sole flue (8) are separated from each other by a partition (9) and are connected to each other via a transition region (10); and wherein the lower oven (3) comprises secondary air supply openings (11) for supplying secondary air into the outer sole flue (7) and into the inner sole flue (8). The openings (4) in the downcomer channels, the outer sole flue (7), the transition region (10), the inner sole flue (8) and the exhaust gas collecting channel (6) are configured in such a manner that the gas is conducted out of the upper oven via the openings (4) in the downcomer channels into the outer sole flue (7) of the lower oven (3), flows through the outer sole flue (7), is deflected in the transition region (10), flows through the inner sole flue (8) and leaves the lower oven (3) via the exhaust gas collecting channel (6). The transition region (10) is divided into a plurality of flow channels (12) by a plurality of blocking elements (13). The extent (U) of the transition region (10) along the main direction of extent of the lower oven (3) is preferably at most 30% of the overall extent of the interior (U) of the lower oven (3).

FIG. 2 shows other details of the coke oven in a further embodiment according to FIG. 1. In this embodiment, only three secondary air supply openings (11) are arranged in the inner sole flue. The openings (4) in the downcomer channels are arranged here in a lateral wall (14) which laterally bounds the lower oven (3) and the outer sole flue (7) thereof. A plurality of openings (4) in the downcomer channels are arranged along the main direction of extent of the lower oven (3), wherein the one outer opening (4*a*) to the one outer outside edge (15) of the lower oven (3) and the other outer opening (4*e*) to the other outer outside edge (16) of the lower oven (3) are at a distance X within the range of 0.1 m≤X≤2.5 m in each case along the main direction of extent of the lower oven (3) and in each case independently of each other; and wherein two adjacent openings (4), i.e. openings (4*a*) and (4*b*), and/or (4*b*) and (4*c*), and/or (4*c*) and (4*d*), and/or (4*d*) and (4*e*), are preferably at a distance Y within the range of 1.0 m≤Y≤4.8 m in each case along the main direction of extent of the lower oven (3) and in each case independently of each other.

FIG. 3 shows other details of the coke oven according to FIG. 1 and FIG. 2. A plurality of secondary air supply openings (11') are arranged along the main direction of extent of the lower oven (3) in the outer sole flue (7), and a plurality of secondary air supply openings (11) are arranged along the main direction of extent of the lower oven (3) in the inner sole flue (8). In this case, four secondary air supply openings (11*b*'), (11*c*'), (11*d*') and (11*e*') are arranged in the outer sole flue (7), and four secondary air supply openings (11*a*), (11*b*), (11*c*) and (11*d*) are arranged in the inner sole flue (8), wherein the secondary air supply openings (11) and the secondary air supply openings (11') in each case independently of one another preferably comprise a throughflow cross-sectional area C within the range of 0.01 $m^2$≤C≤0.16 $m^2$. Preferably, the one outer secondary air supply opening (11*a*) to the one outer outside edge (15) of the lower oven (3) and the other outer secondary air supply opening (11*e*') to the other outer outside edge (16) of the lower oven (3) are at a distance P within the range of 0.1 m≤P≤2.5 m in each case along the main direction of extent of the lower oven (3) and in each case independently of each other. Preferably, two adjacent secondary air supply openings (11), i.e. (11*a*) and (11*b*), and/or (11*b*) and (11*c*), and/or (11*c*) and (11*d*), are at a distance Q within the range of 1.0 m≤Q≤4.8 m from each other in each case along the main direction of extent of the lower oven (3) and in each case independently of each other. Preferably, two adjacent secondary air supply openings (11'), i.e. (11*b*') and (11*c*'), and/or (11*c*') and (11*d*'), and/or (11*d*') and (11*e*'), are at a distance Q' within the range of 1.0 m≤Q'≤4.8 m from each other in each case along the main direction of extent of the lower oven (3) and in each case independently of each other.

FIG. 4 shows other details and a preferred embodiment of the coke oven according to FIGS. 1 to 3. In this case, at least one opening (4) in the downcomer channels is arranged orthogonally to the main direction of extent of the lower oven (3) substantially in alignment with a secondary air supply opening (11') in the outer sole flue (7) and/or substantially in alignment with a secondary air supply opening (11) in the inner sole flue (8). Preferably, opening (4*b*) in the downcomer channel and secondary air supply opening (11*b*') are arranged orthogonally to the main direction of extent of the lower oven in each case substantially in alignment with each other; opening (4*c*) in the downcomer channel and secondary air supply opening (11*c*') are arranged orthogonally to the main direction of extent of the lower oven in each case substantially in alignment with each other; and opening (4*d*) in the downcomer channel and secondary air supply opening (11*d*') are arranged orthogonally to the main direction of extent of the lower oven in each case substantially in alignment with each other.

FIG. 5 shows other details of the coke oven according to FIGS. 1 to 3. The direction of flow of the gases is arranged schematically by means of arrows, and the concentric circles illustrate the positions of the flames of the secondary combustion. The throughflow cross section D of the openings (4) in the downcomer channels can be changed individually and independently of one another with sliding bricks (17).

Figure 6:
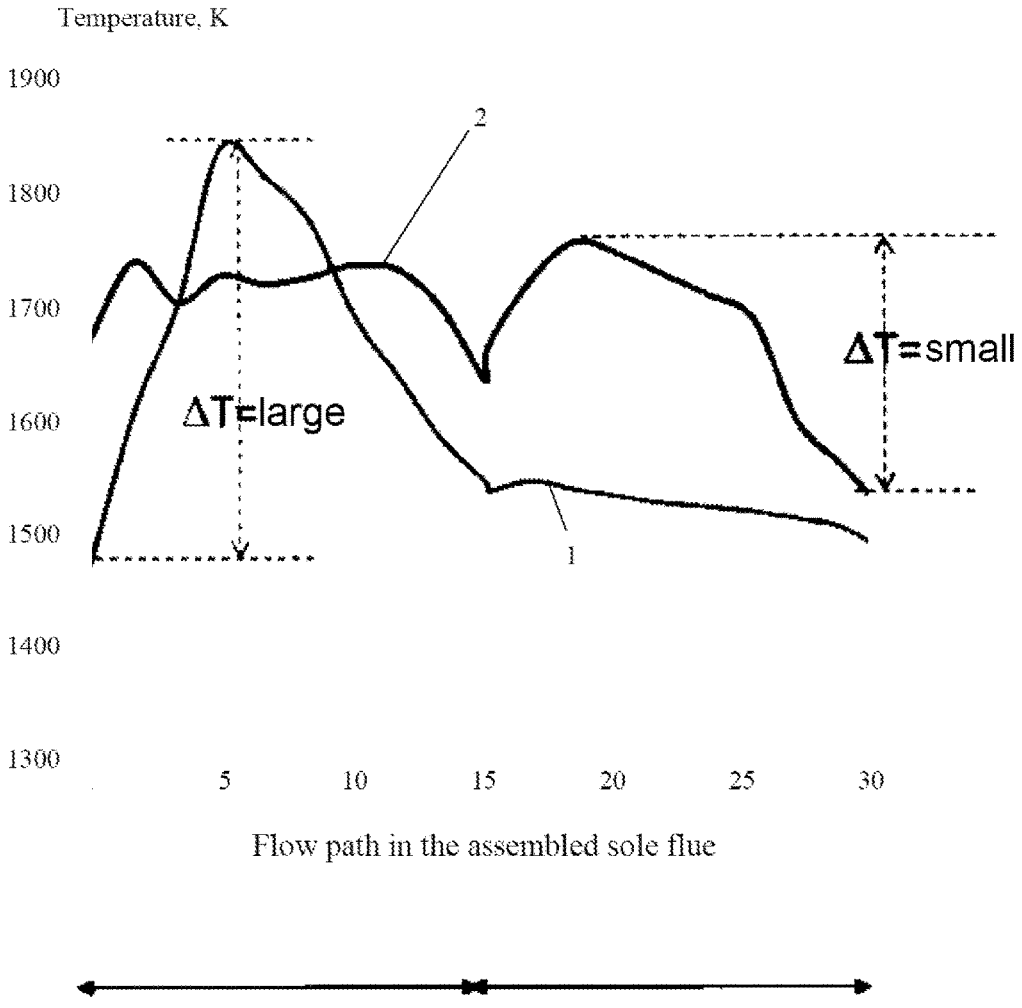
FIG. 6 is a plot of temperature versus flow path in an assembled sole flue.

FIG. 6 shows the advantages (curve 2) of the multi-flame solution according to the invention with a multiple deflection in the transition region from the outer into the inner sole flue. The more uniform temperature level in comparison to the prior art (curve 1) ensures a greater vertical transmission of heat from the lower oven into the upper oven and into the coal charge to be heated. Temperature peaks in the sole flues are avoided, and the risk of exceeding the maximum temperature use limit of the silica material used is circumvented. In addition, temperature sinks and the risk of cooling down of the sole flues are avoided, which would otherwise be associated with a lower transmission of heat upward into the coal charge and lower exhaust gas temperatures, i.e. with lower production of steam in the case of an HR coke oven.

LIST OF REFERENCE NUMBERS (1) Coke oven
(3) Lower oven
(4) Openings in the downcomer channels
(6) Exhaust gas collecting channel
(7) Outer sole flue
(8) Inner sole flue
(9) Partition
(10) Transition region
(11) Secondary air supply openings
(12) Flow channels
(13) Blocking elements
(14) Lateral wall
(15) An outer outside edge of the lower oven
(16) Other outer outside edge of the lower oven
(17) Sliding bricks

What is claimed is:

1. A coke oven comprising:

an upper oven that comprises
a coking chamber, and
a device for supplying primary air;

a lower oven disposed below the upper oven, the lower oven comprising
an exhaust gas collecting channel,
an outer sole flue and an inner sole flue for conducting gas, the outer sole flue and the inner sole flue being separated by a partition but connected via a transition region, wherein the transition region is divided into a plurality of flow channels, and
secondary air supply openings for supplying secondary air into the outer sole flue and into the inner sole flue; and a plurality of downwardly-directed downcomer channels with openings that are configured to conduct gas out of the upper oven into the lower oven, wherein the openings are disposed along a main direction of extent of the lower oven, with a first outer opening to a first outer outside edge of the lower oven being at a distance of 0.1 m to 2.5 m as measured along the main direction of extent of the lower oven, with a second outer opening to a second outer outside edge of the lower oven being at a distance of 0.1 m to 2.5 m as measured along the main direction of extent of the lower oven, wherein the openings in the plurality of downwardly-directed downcomer channels, the outer sole flue, the transition region, and inner sole flue, and the exhaust gas collecting channel are configured such that the gas from the upper oven is directed via the openings in the plurality of downwardly-directed downcomer channels into the outer sole flue of the lower oven, where the gas flows through the outer sole flue, is deflected in the transition region, flows through the inner sole flue, and exits the lower oven via the exhaust gas collecting channel.

2. The coke oven of claim 1 wherein at least one of:

the transition region is U-shaped;

an extent of the transition region along the main direction of extent of the lower oven is at most 30% of an entire extent of an interior of the lower oven;

the plurality of flow channels are each configured such that the gas is deflected from the outer sole flue into the inner sole flue;

the outer sole flue and the inner sole flue are positioned substantially horizontally and parallel to each other and are configured such that the gas flows through them substantially in an opposed direction;

the transition region is divided into 2 to 10 flow channels; or the plurality of flow channels independently of one another each comprise a throughflow cross-sectional area of 0.02 $m^2$ to 0.85 $m^2$.

3. The coke oven of claim 1 wherein the transition region is divided by 1 to 10 blocking elements into the plurality of flow channels.

4. The coke oven of claim 3 wherein at least one of:

each of the 1 to 10 blocking elements is rounded, or each of the 1 to 10 blocking elements comprises a cross-sectional area between 0.01 $m^2$ to 0.15 $m^2$.

5. The coke oven of claim 1 wherein a quantity of the openings in the plurality of downwardly-directed downcomer channels is at least five, wherein at least five of the openings in the plurality of downwardly-directed downcomer channels are disposed in a lateral wall that laterally bounds the lower oven and the outer sole flue.

6. The coke oven of claim 1 wherein at least one of:

the openings in the plurality of downwardly-directed downcomer channels are disposed in a lateral wall that laterally bounds the lower oven and the outer sole flue; or two adjacent openings of the openings in the plurality of downwardly-directed downcomer channels are at a distance in a range of 1.0 m to 4.8 m in each case along the main direction of extent of the lower oven and in each case independently of each other.

7. The coke oven of claim 1 wherein a quantity of the secondary air supply openings is at least four, wherein at least one of:

at least four of the secondary air supply openings are disposed in the outer sole flue, and/or at least four of the secondary air supply openings are disposed in the inner sole flue; or the secondary air supply openings in each case independently of one another comprise a throughflow cross-sectional area in a range of 0.01 $m^2$ to 0.16 $m^2$.

8. The coke oven of claim 1 wherein some of the plurality of secondary air supply openings are disposed along the main direction of extent of the lower oven in the outer sole flue and some of the plurality of secondary air supply openings are disposed along the main direction of extent of the lower oven in the inner sole flue.

9. The coke oven of claim 8 wherein a first outer opening of the secondary air supply openings to the first outer outside edge of the lower oven is at a distance of 0.1 m to 2.5 m as measured along the main direction of extent of the lower oven, wherein a second outer opening of the secondary air supply openings to the second outer outside edge of the lower oven is at a distance of 0.1 m to 2.5 m as measured along the main direction of extent of the lower oven.

10. The coke oven of claim 8 wherein two adjacent openings of the secondary air supply openings are at a distance of between 1.0 m to 4.8 m in each case along the main direction of extent of the lower oven and in each case independently of each other.

11. The coke oven of claim 1 wherein at least one of the openings in the plurality of downwardly-directed downcomer channels is disposed orthogonally to the main direction of extent of the lower oven substantially in alignment with one of the secondary air supply openings in the outer sole flue.

12. The coke oven of claim 1 further comprising sliding bricks for individually and independently changing a throughflow cross section of the openings in the plurality of downwardly-directed downcomer channels.

13. A method for coking coal, the method comprising firing a coke oven, wherein the coke oven comprises:

an upper oven that comprises a coking chamber, and a device for supplying primary air;

a lower oven disposed below the upper oven, the lower oven comprising an exhaust gas collecting channel, an outer sole flue and an inner sole flue for conducting gas, the outer sole flue and the inner sole flue being separated by a partition but connected via a transition region, wherein the transition region is divided into a plurality of flow channels, and secondary air supply openings for supplying secondary air into the outer sole flue and into the inner sole flue; and a plurality of downwardly-directed downcomer channels with openings that are configured to conduct gas out of the upper oven into the lower oven, wherein the openings are disposed along a main direction of extent of the lower oven, with a first outer opening to a first outer outside edge of the lower oven being at a distance of 0.1 m to 2.5 m as measured along the main direction of extent of the lower oven, with a second outer opening to a second outer outside edge of the lower oven being at a distance of 0.1 m to 2.5 m as measured along the main direction of extent of the lower oven, wherein the openings in the plurality of downwardly-directed downcomer channels, the outer sole flue, the transition region, and inner sole flue, and the exhaust gas collecting channel are configured such that the gas from the upper oven is directed via the openings in the plurality of downwardly-directed downcomer channels into the outer sole flue of the lower oven, where the gas flows through the outer sole flue, is deflected in the transition region, flows through the inner sole flue, and exits the lower oven via the exhaust gas collecting channel.

14. The method of claim 13 further comprising regulating a throughflow cross section of the openings in the plurality of downwardly-directed downcomer channels individually and independently of one another with sliding bricks such that the gas directed out of the upper oven via the openings in the plurality of downwardly-directed downcomer channels into the outer flue of the lower oven is distributed uniformly between the openings in the plurality of downwardly-directed downcomer channels.

15. The method of claim 13 wherein at least five of the openings in the plurality of downwardly-directed downcomer channels are disposed in a lateral wall that laterally bounds the lower oven and the outer sole flue, wherein a throughflow cross section of the openings in the plurality of downwardly-directed downcomer channels is changeable individually and independently of one another with sliding bricks, wherein when fully open the throughflow cross section of each of the at least five of the openings is substantially identical, wherein the throughflow coss section of the openings is regulated with the sliding bricks such that at least one of a first opening is up to 70% to 100% open, a second opening is up to 80% to 100% open, or a third opening is up to 85% to 100% open.

* * * * *